US007572148B1

(12) United States Patent
Pepe et al.

(10) Patent No.: US 7,572,148 B1
(45) Date of Patent: Aug. 11, 2009

(54) COUPLER FOR INTERCONNECTING ELECTRICAL CONNECTORS

(75) Inventors: Paul John Pepe, Clemmons, NC (US); James Shannon Hower, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/027,329

(22) Filed: Feb. 7, 2008

(51) Int. Cl.
*H01R 13/648* (2006.01)

(52) U.S. Cl. ..... 439/608; 439/638; 439/676

(58) Field of Classification Search ..... 439/608, 439/676, 638
See application file for complete search history.

(56) References Cited

U.S. PATENT DOCUMENTS

| | | | | |
|---|---|---|---|---|
| 5,013,262 | A | 5/1991 | Shibano | |
| 5,074,804 | A | 12/1991 | Pantland et al. | |
| 5,175,928 | A | 1/1993 | Grabbe | |
| 5,234,358 | A | 8/1993 | Polgar | |
| 5,599,202 | A | 2/1997 | Key | |
| 5,697,806 | A | 12/1997 | Whiteman, Jr. et al. | |
| 5,791,943 | A | 8/1998 | Lo et al. | |
| 5,885,111 | A | 3/1999 | Yu | |
| 5,895,292 | A | 4/1999 | Affeltranger | |
| 5,989,071 | A | 11/1999 | Larsen et al. | |
| 6,010,353 | A | 1/2000 | Ensz et al. | |
| 6,056,586 | A | 5/2000 | Lin | |
| 6,077,122 | A | 6/2000 | Elkhatib et al. | |
| 6,080,018 | A | 6/2000 | Ferrill et al. | |
| 6,129,586 | A | 10/2000 | Bellemon | |
| 6,135,822 | A | 10/2000 | Hwang | |
| 6,267,617 | B1 | 7/2001 | Nozick | |
| 6,283,792 | B1 | 9/2001 | Tolmie et al. | |
| 6,287,149 | B1 | 9/2001 | Elkhatib et al. | |
| 6,494,743 | B1 | 12/2002 | Lamatsch et al. | |
| 6,592,396 | B2 | 7/2003 | Pepe et al. | |
| 6,623,310 | B1 * | 9/2003 | Billman et al. | 439/701 |
| 6,629,858 | B2 | 10/2003 | Lo et al. | |
| 6,702,617 | B1 | 3/2004 | Clement et al. | |
| 6,716,054 | B1 | 4/2004 | Denovich et al. | |
| RE38,519 | E | 5/2004 | Doorhy et al. | |
| 6,758,695 | B2 | 7/2004 | Pepe et al. | |
| 6,776,629 | B2 * | 8/2004 | Shuey | 439/108 |
| 6,780,054 | B2 | 8/2004 | Yip et al. | |
| 6,830,488 | B2 | 12/2004 | Bush et al. | |
| 6,910,897 | B2 | 6/2005 | Driscoll et al. | |
| 6,953,362 | B2 | 10/2005 | Mossner et al. | |
| 7,104,808 | B2 * | 9/2006 | Korsunsky et al. | 439/76.1 |
| 7,195,518 | B2 | 3/2007 | Bert et al. | |
| 2007/0141908 | A1 | 6/2007 | Bert et al. | |

FOREIGN PATENT DOCUMENTS

| | | |
|---|---|---|
| EP | 1 137 119 A2 | 9/2001 |

* cited by examiner

*Primary Examiner*—Ross N Gushi

(57) ABSTRACT

A coupler includes a coupler body having a first mating end defining a first mating interface configured for mating with a first mating connector and a second mating end defining a second mating interface configured for mating with a second mating connector. A contact sub-assembly is received within the coupler body, wherein the contact sub-assembly has first contacts grouped in differential pairs and presented at the first mating end and second contacts grouped in differential pairs and presented at the second mating end. At least one shielding member is located within the coupler body, wherein the at least one shielding member isolates each differential pair of first contacts from an adjacent differential pair of the first contacts.

20 Claims, 16 Drawing Sheets

COUPLER FOR INTERCONNECTING ELECTRICAL CONNECTORS

BACKGROUND OF THE INVENTION

The subject matter herein relates generally to connector assemblies, and more particularly, to a coupler for interconnecting electrical connectors.

In electrical systems, there is increasing concern for preserving signal integrity as signal speed and bandwidth increase. The degree of signal degradation, or amplitude of crosstalk, generally increases as the frequency increases.

For example, a typical industry standard type RJ-45 communication connector includes four pairs of conductors defining different signal paths. The RJ-45 plug design is dictated by industry standards and is inherently susceptible to crosstalk. Additional crosstalk can be created by the contacts in the jack that interface with the contacts in the plug.

Due to the problems that are inherent in connectors such as the RJ-45 jacks, alternative jacks having enhanced interfaces have been developed to enhance performance. For example, Tyco Electronics Corporation described an electrical connector with enhanced jack interface in U.S. Pat. No. 7,195,518, the subject matter of which is herein incorporated by reference in its entirety. However, a need remains for interconnecting network devices using such electrical connectors with one another and with other network devices incorporating other types of electrical connectors, such as standard RJ-45 jacks.

BRIEF DESCRIPTION OF THE INVENTION

In one embodiment, a coupler is provided that includes a coupler body having a first mating end defining a first mating interface configured for mating with a first mating connector and a second mating end defining a second mating interface configured for mating with a second mating connector. A contact sub-assembly is received within the coupler body, wherein the contact sub-assembly has first contacts grouped in differential pairs and presented at the first mating end and second contacts grouped in differential pairs and presented at the second mating end. At least one shielding member is located within the coupler body, wherein the at least one shielding member isolates each differential pair of first contacts from an adjacent differential pair of the first contacts.

Optionally, the at least one shield member may isolate each differential pair of second contacts from an adjacent differential pair of the second contacts. The first contacts may be integrally formed with corresponding second contacts. The first contacts may be electrically connected to corresponding second contacts. Optionally, the first contacts may be arranged in a first pattern and the second contacts may be arranged in a second pattern that is different than the first pattern. The first contacts may be arranged to connect with mating contacts of a quad-plug connector, and the second contacts may be arranged to connect with mating contacts of a standard RJ-45 plug connector. The at least one shielding member may define compartments within the coupler body, and the contact sub-assembly may include contact modules each holding a differential pair of at least one of the first contacts and the second contacts. Each contact module may be received in a corresponding one of the compartments.

In another embodiment, a coupler is provided including a coupler body having a first mating end defining a first mating interface and a second mating end defining a second mating interface different than the first mating interface. A contact sub-assembly is received within the coupler body, wherein the contact sub-assembly has a plurality of contact modules each holding a differential pair of first contacts. At least one shielding member is located within the coupler body, wherein the at least one shielding member isolates each contact module from an adjacent contact module.

Optionally, the first mating interface is configured for mating with a quad-type of mating connector representing a data communication plug, and the second mating interface is configured for mating with a standard RJ-45 type of mating connector representing a RJ-45 plug. The contact sub-assembly includes a circuit board and a plurality of second contacts terminated to the circuit board, wherein the second contacts are presented at the second mating interface, and the first contacts are terminated to the circuit board and electrically connected with corresponding second contacts by the circuit board. Optionally, the contact sub-assembly may include a circuit board, wherein the contact modules extend from a first surface of the circuit board and a tray extends from a second surface of the circuit board. Pairs of the first contacts are held by the contact modules and the second contacts are held by the tray.

In a further embodiment, a coupler is provided including a coupler body having a first mating end, a second mating end and a plurality of compartments extending along a longitudinal axis and being exposed at each of the first and second mating ends. A plurality of contact sub-assemblies are each received within corresponding compartments. Each contact sub-assembly has a pair of contacts that are presented at both the first mating end and the second mating end for mating engagement with mating contacts of first and second mating connectors received within the coupler body at the first and second mating ends, respectively. At least one shielding member is provided between the contact sub-assemblies for isolating the differential pairs of contacts from one another.

Optionally, the coupler body defines a plurality of zones arranged in quadrants with each quadrant receiving a different contact sub-assembly. The contacts at the first and second mating ends may be unitarily formed. The differential pairs of contacts may be symmetrically arranged about the longitudinal axis. Optionally, a first mating interface may be defined at the first mating end and a second mating interface may be defined at the second mating end, wherein the first and second mating interfaces are substantially identically formed. The coupler body may be configured to receive the first mating connector, and the contacts may be configured to mate with the mating contacts of the first mating connector, at either the first mating end or the second mating end.

DETAILED DESCRIPTION OF THE INVENTION

Figure 1:
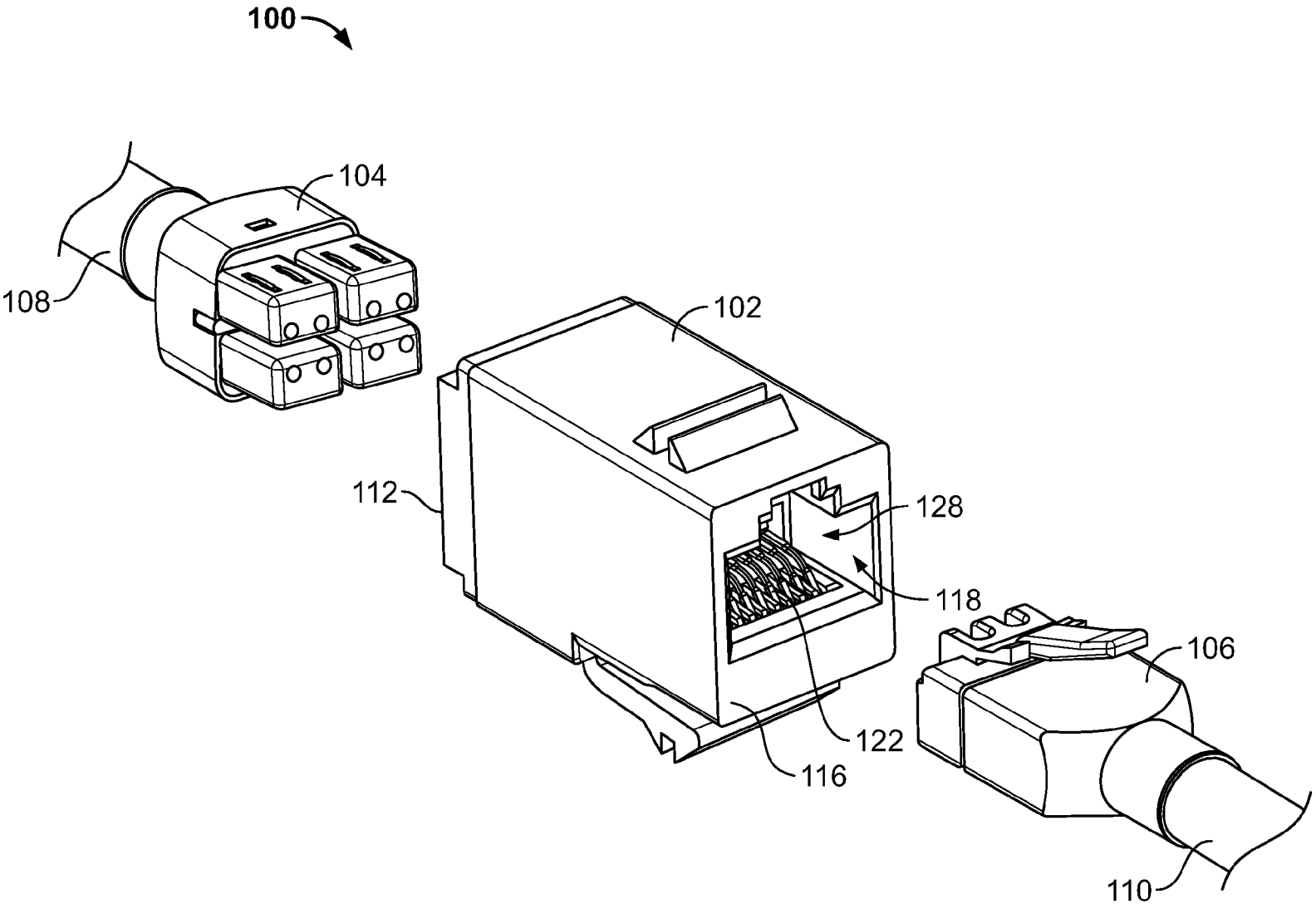
FIG. 1 is a front perspective view of a connector assembly in an unassembled state illustrating a coupler for interconnecting first and second mating connectors.
Figure 2:
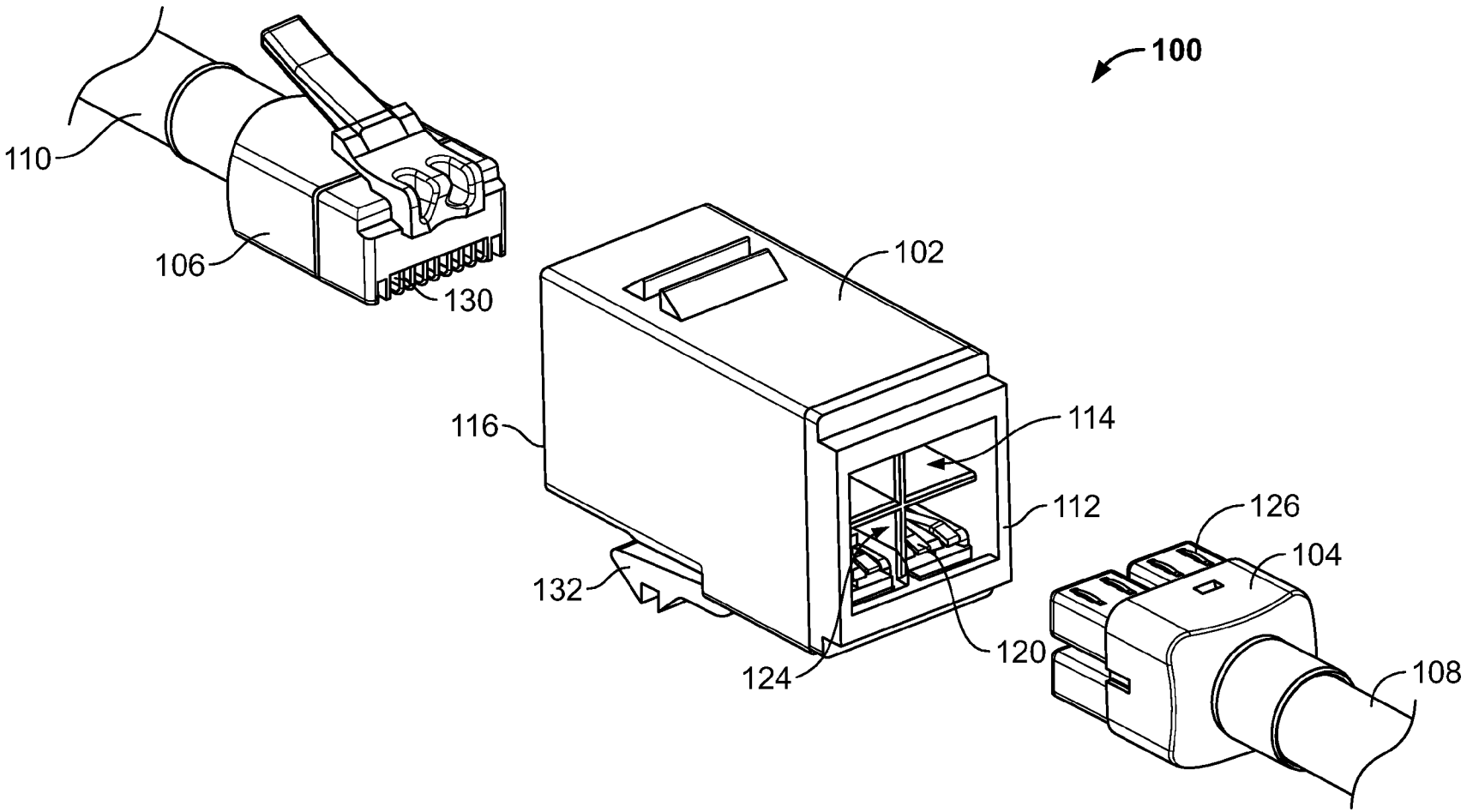
FIG. 2 is a rear perspective view of the connector assembly shown in FIG. 1.

FIG. 1 is a front perspective view of a connector assembly 100 in an unassembled state including a coupler 102 for interconnecting first and second mating connectors 104, 106. FIG. 2 is a rear perspective view of the connector assembly 100. In an exemplary embodiment, the mating connectors 104, 106 define plug-type communication connectors each having four pairs of conductors defining different signal paths. Optionally, the first mating connector 104 may define a quad-type plug having contacts arranged in quadrants, such as the quad-type plug described in commonly owned U.S. patent application Ser. No. 11/707,612, titled "Electrical Connector with Enhanced Jack Interface", the disclosure and subject matter of which is herein incorporated by reference in its entirety. The second mating connector 106 may be a standard RJ-45 plug connector. Optionally, the first and second mating connectors 104, 106 may both be quad-type plugs. While the connector assembly 100 is described in terms of an assembly carrying four differential signal pairs, other connectors carrying fewer or greater numbers of signal pairs may be accommodated in alternative embodiments. The mating connectors 104, 106 are provided at the ends of cables 108, 110. The coupler 102 may thus be used to interconnect two cables, such as data cables or communication cables within a network.

The coupler 102 has a first mating end 112 defining a first mating interface 114 (shown in FIG. 2) and a second mating end 116 defining a second mating interface 118 (shown in FIG. 1). The first and second mating interfaces 114, 118 are different than one another to accommodate different types of mating connectors 104, 106. The coupler 102 holds a plurality of first contacts 120 (shown in FIG. 2) grouped in differential pairs and presented at the first mating end 112. The first contacts 120 are arranged in a first pattern that complements mating contacts of the first mating connector 104. The differential pairs may be provided in different zones of the mating interface 114. In one embodiment, the mating interface 114 defines four zones arranged in quadrants, and one differential pair of first contacts 120 is arranged in each quadrant. The coupler 102 also holds a plurality of second contacts 122 (shown in FIG. 2) grouped in differential pairs and presented at the second mating end 116. The second contacts 122 are arranged in a second pattern that complements mating contacts of the second mating connector 106. The second pattern may be substantially the same as, or substantially different from, the first pattern in different embodiments. In the illustrated embodiment, the second contacts 122 are generally arranged in a row, and optionally, one differential pair of the second contacts 122 may be split around another differential pair of the second contacts 122. The first contacts 120 are electrically connected with corresponding ones of the second contacts 122 to send signals between the first mating end 112 and the second mating end 116. Optionally, the first and second contacts 120, 122 may be unitarily formed with one another.

The coupler 102 includes a first opening 124 (shown in FIG. 2) at the first mating end 112 that receives the first mating connector 104 therein. The first contacts 120 are exposed within the first opening 124 for mating engagement with corresponding first mating contacts 126 of the first mating connector 104. The first contacts 120 are arranged in a similar pattern as the mating contacts 126 of the first mating connector 104 for interconnection therebetween. Similarly, the coupler 102 includes a second opening 128 (shown in FIG. 1) at the second mating end 116 that receives the second mating connector 106 therein. The second contacts 122 are exposed within the second opening 128 for mating engagement with corresponding second mating contacts 130 of the second mating connector 106. The second contacts 122 are arranged in a similar pattern as the second mating contacts 130 of the second mating connector 106 for interconnection therebetween.

In an exemplary embodiment, the coupler 102 includes at least one latch 132 for securely mounting the coupler 102 to a structure, such as a wall or panel, or alternatively, in an electrical device or apparatus (not shown) having a communications port through which the device may communicate with other external networked devices.

Figure 3:
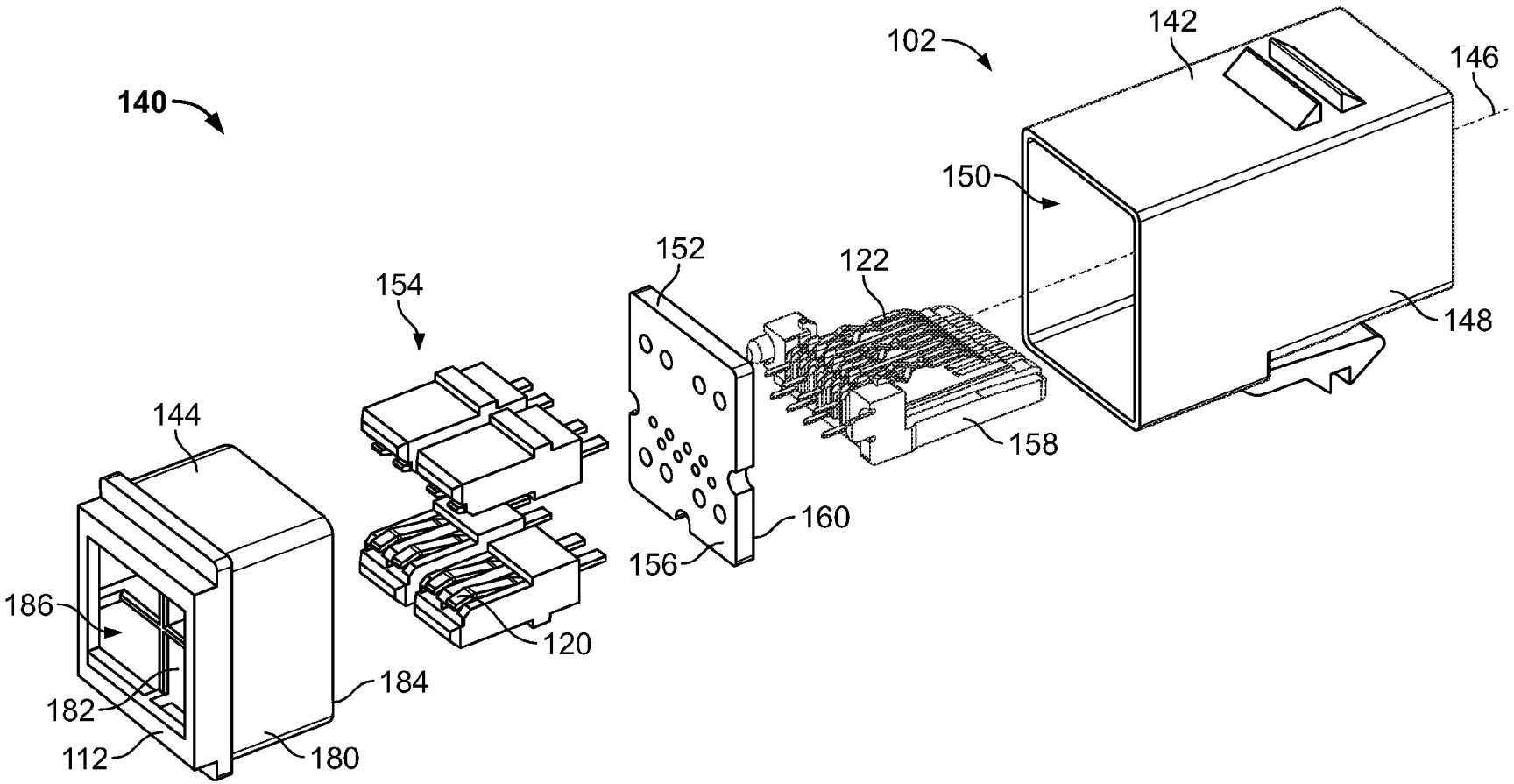
FIG. 3 is an exploded view of the coupler shown in FIG. 1 illustrating a contact sub-assembly.

FIG. 3 is an exploded view of the coupler 102 illustrating a contact sub-assembly 140. The coupler 102 includes a generally rectangular body 142 and an end cap 144 both of which may be fabricated from a conductive material to thereby shield the interior of the coupler 102. In an exemplary embodiment, the body 142 and end cap 144 are fabricated from die cast metal. Other materials, such as metalized plastic may be used in other embodiments. The body 142 extends along a longitudinal axis 146 and includes exterior walls 148 that define an inner chamber 150. The contact sub-assembly 140 is loaded into the inner chamber 150 and held therein by the end cap 144. The first electrical connector 104 is received within the body 142 and held therein, such as by a friction fit or by a latching mechanism.

The contact sub-assembly 140 includes a base 152, a plurality of contact modules 154 extending from a first surface 156 of the base 152 and a tray 158 extending from a second surface 160 of the base 152. The contact modules 154 hold the first contacts 120 and the tray 158 holds the second contacts 122. In an exemplary embodiment, the base 152 represents a printed circuit board, and may be referred to hereinafter as printed circuit board 152. The printed circuit board 152 electrically interconnects the first and second contacts 120, 122, such as by traces routed along the first and/or second surface 156, 160 of the printed circuit board 152. The contacts 120, 122 are terminated to the printed circuit board 152 according to any known method, such as through-hole mounting, soldering, and the like.

In alternative embodiments, the contacts 120, 122 may be directly connected to one another, such as by a pin and socket type of connection, soldering, or any other direct connection method. Such direct connection method may be in lieu of using a printed circuit board as the base 152. Other alternative embodiments may use contacts that are unitarily formed with first and second contact portions presented at the first and second mating ends 112, 116. For example, the base 152 may be used to support a leadframe that includes the unitarily formed contacts.

Figure 4:
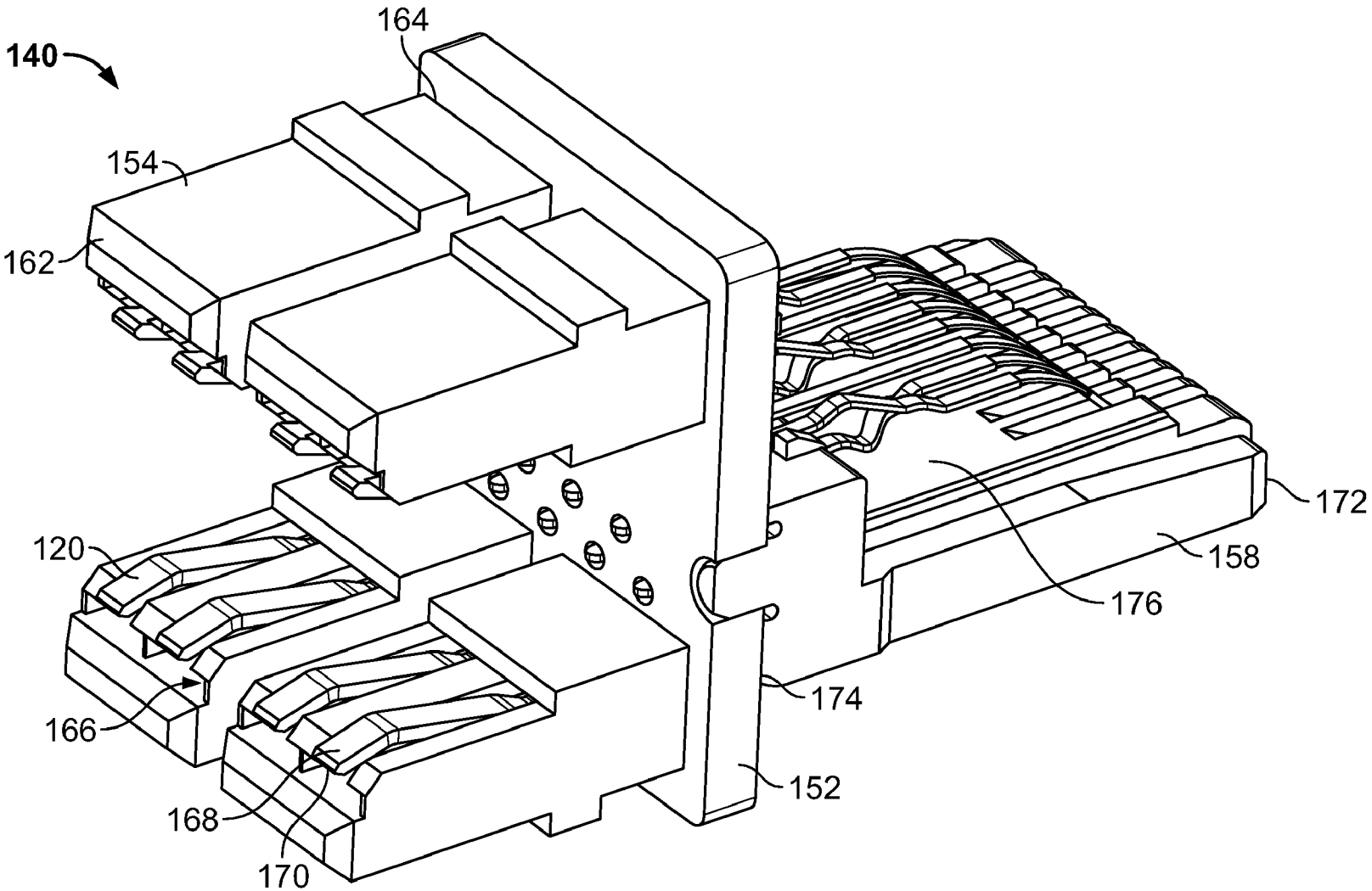
FIG. 4 is an assembled view of the contact sub-assembly shown in FIG. 3.

FIG. 4 is an assembled view of the contact sub-assembly 140 with the contact modules 154 and tray 158 coupled to the printed circuit board 152. The contact modules 154 each have a mating end 162 and a mounting end 164. Each contact module 154 holds a pair of the first contacts 120 that are inserted into contact slots 166 of the contact module 154 through the mating end 162. When assembled, the contact modules 154 arrange the first contacts 120 in a predetermined pattern, such as in quadrants. In an exemplary embodiment, the first contacts 120 are generally arranged in two rows of contacts, an upper row and a lower row. Each first contact 120 within a differential pair and held by, and electrically isolated from one another by, the respective contact module 154. Each contact module 154 is fabricated from a specific dielectric material selected to provide desired electrical performance. In an exemplary embodiment, each contact module 154 is fabricated from a polycarbonate material.

Each first contact 120 defines a terminal-type of contact having a generally planar body that is stamped and formed into the first contact 120. The first contact 120 includes a flexible beam 168 that extends to a mating end 170. The first contact 120 is terminated to the printed circuit board 152 at the end opposite to the mating end 170. The flexible beam 168 may be bent out of plane to facilitate interconnection with the mating contacts 126 (shown in FIG. 2). Other types of contacts may be provided in alternative embodiments.

The tray 158 has a mating end 172 and a mounting end 174. The tray 158 includes a support surface 176 that supports each of the second contacts 122. The tray 158 arranges the second contacts 122 in a pattern for mating engagement with the second mating connector 106. In an exemplary embodiment, the tray 158 arranges the second contacts 122 to define an RJ-45 receptacle interface for mating with an RJ-45 plug.

Returning to FIG. 3, the end cap 144 includes exterior walls 180 and interior walls 182 that extend along the axis 146 between the first mating end 112 and a loading end 184 that is loaded into the body 142 of the coupler 102. The interior walls 182 divide the end cap 144 into a plurality of compartments or wells 186, each of which may receive one of the contact modules 154. The compartments 186 are arranged about the longitudinal axis 146 to define different zones or quadrants in the case when four compartments 186 are provided. The interior walls 182 generally extend along the axis 146 between the first mating end 112 and the loading end 184. The interior walls 182 are formed from a conductive material and thereby act as shielding members that shield each contact module 154 from adjacent contact modules 154. The interior walls 182 thus act as shielding members and may be referred to hereinafter as shielding members 182. In an exemplary embodiment, the shielding members 182 are integrally formed with the end cap 144. However, in an alternative embodiment, the shielding members 182 may be separately provided from the end cap 144.

Figure 5:
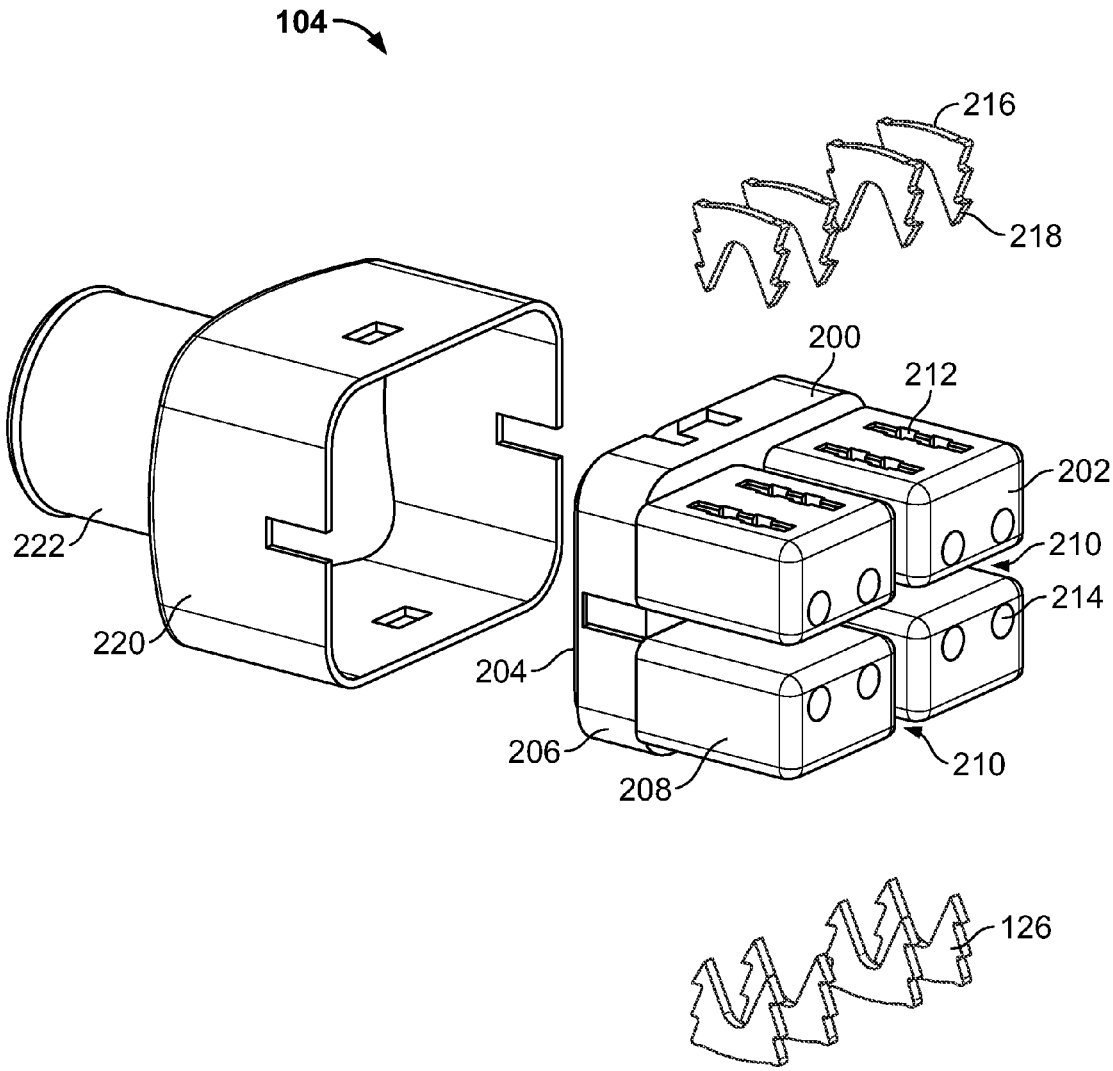
FIG. 5 is an exploded view of the first mating connector shown in FIG. 1.

FIG. 5 is an exploded view of the first mating connector 104. The first mating connector 104 includes a housing 200 that has a mating end 202 configured to mate with the coupler 102 (shown in FIG. 1) and a wire receiving end 204 that is configured to receive the cable 108 that includes multiple conductors or wires. In an exemplary embodiment, the housing 200 includes a base 206 and a plurality of cantilevered beams 208 extending from the base 206. The beams 208 are spaced apart to define clearance channels 210. In an exemplary embodiment, two orthogonally oriented clearance channels 210 are provided that separate four beams 208 into quadrants.

The first mating contacts 126 are loaded into slots 212 in the beams 208 for mating engagement with corresponding ones of the wires from the cable 108. For example, the wires may be loaded into wire passages 214 at the wire receiving end 204. Each of the slots 212 open to a corresponding one of the wire passages 214. Once the wires are positioned within the wire passages 214, the first mating contacts 126 are loaded into the slots 212 and engage the wires. In an exemplary embodiment, the first mating contacts 126 have a mating edge 216 at an end thereof that is exposed when the first mating contacts 126 are loaded into the slots 212. The first mating contacts 126 have insulation piercing barbs 218 at opposed ends thereof that pierce the insulation of the wires to make electrical contact therewith. However, other types of interconnections may be made between the wires and the first mating contacts 126, such as insulation displacement, soldering, crimping, and the like.

An external shield 220 is coupled to the housing 200 and surrounds at least a portion of the housing 200 and the wires entering the housing 200. The external shield 220 has a ferrule 222 at an end thereof for securely engaging with the cable 108. The external shield 220 isolates the first mating connector 104, and the wires therein, from noise from neighboring connectors, cables or other external sources. As described in further detail below, the external shield 220 may provide an electrical path, such as a ground path, between the coupler 102 and a shielded cable, when used. In an exemplary embodiment, the external shield 220 is fabricated from a conductive metal material. Other materials, such as metalized plastic may be used in other embodiments.

Figure 6:
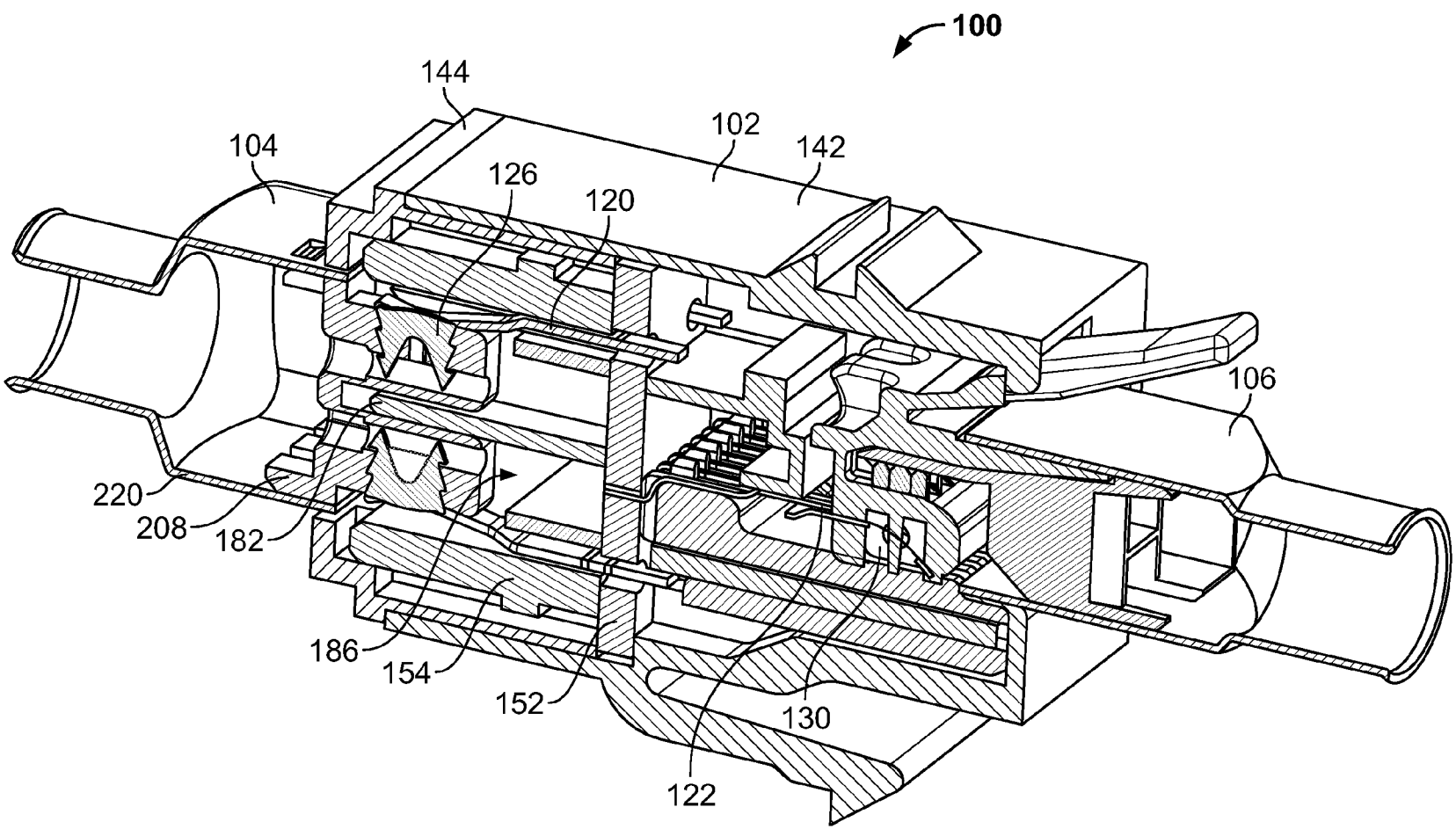
FIG. 6 is a cross-sectional view of the connector assembly shown in FIG. 1 in an assembled state.

FIG. 6 is a cross-sectional view of the connector assembly 100 in an assembled state with the cables 108, 110 and associated wires removed for clarity. In the illustrated embodiment, the first and second mating connectors 104, 106 are plugged into the coupler 102, which operates to interconnect the first and second mating connectors 104, 106 with one another. In particular, the first contacts 120 electrically connect to corresponding ones of the first mating contacts 126 and the second contacts 122 electrically connect to corresponding ones of the second mating contacts 130. The printed circuit board 152 electrically interconnects the first and second mating contacts 120, 122, such as by plated through-holes.

In an exemplary embodiment, the shielding members 182 provide internal shielding and/or isolation between the compartments 186 and associated beams 208 and contact modules 154. As such, each differential pair of the first contacts 120 are shielded from one another. Additionally, the external shield 220 of the first mating connectors 104 is electrically connected to the body 142 and/or end cap 144. Similarly, the second mating connector 106 may be a shielded plug that is electrically connected to the body 142. The external shield 220 and the shielded body of the second mating connector 106 may be directly coupled to a braided shield of the respective cables 108, 110.

Figure 7:
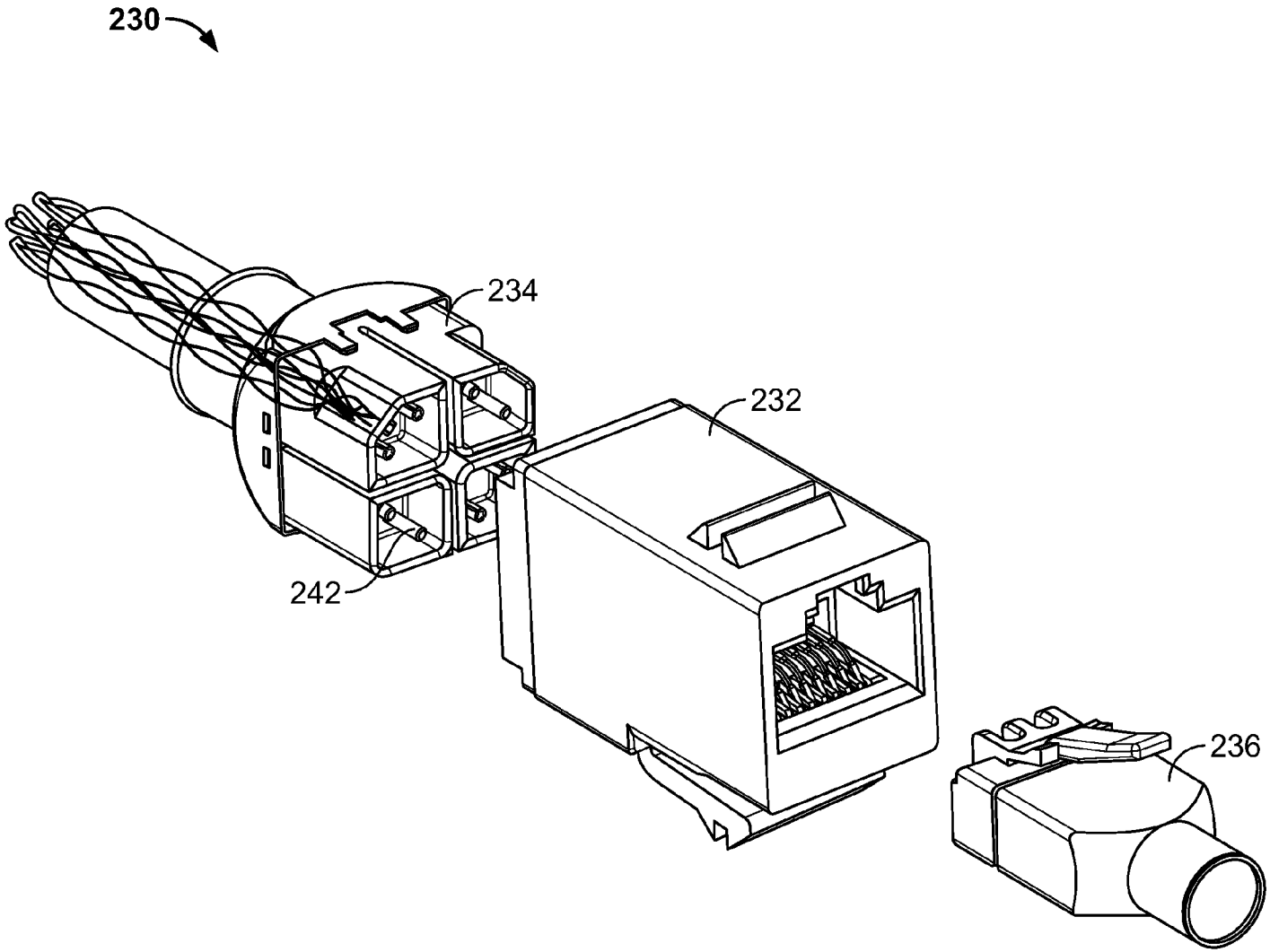
FIG. 7 is a front perspective view of an alternative connector assembly in an unassembled state illustrating an alternative coupler for interconnecting an alternative mating connector.

FIG. 7 is a front perspective view of an alternative connector assembly 230 in an unassembled state illustrating an alternative coupler 232 for interconnecting a first mating connector 234 and a second mating connector 236. In the illustrated embodiment, the first mating connector 234 is a different type of quad connector than described above. The second mating connector 236 is similar to the second mating connector described above and represents an RJ-45 plug connector. The operation of the connector assembly 230 is similar to the operation of the connector assembly 100, however, the interfaces between the coupler 232 and the mating connectors 234, 236 are different than that of the coupler 102 and mating connectors 104, 106. For example, and as described in further detail below, the coupler 232 includes first contacts 240 (shown in FIG. 8), which represent socket-type of contacts, and the first mating connectors 234 includes first mating contacts 242, which represent pin-type of contacts.

Figure 8:
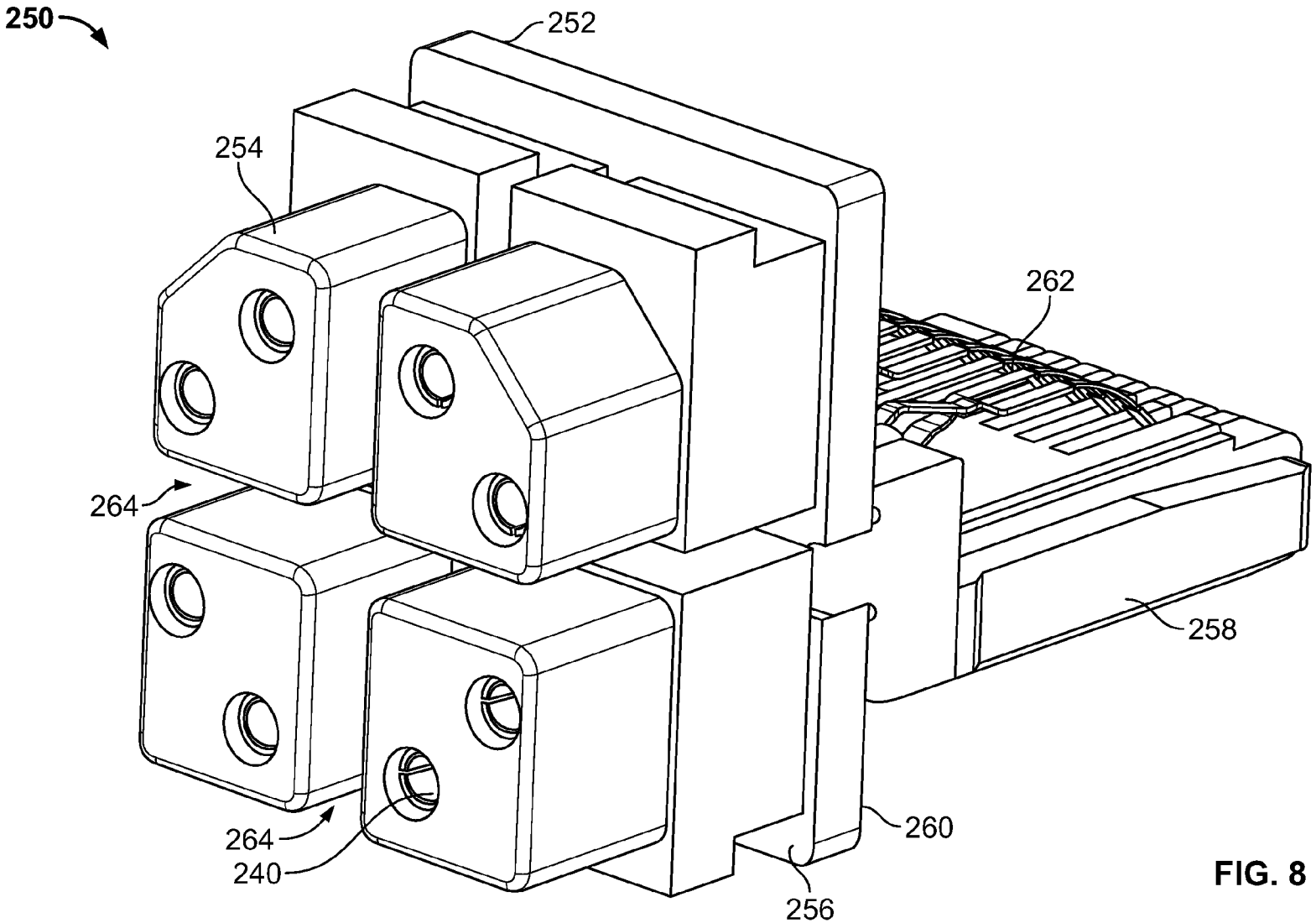
FIG. 8 illustrates an alternative contact sub-assembly for the connector assembly shown in FIG. 7.

FIG. 8 illustrates an alternative contact sub-assembly 250 for the connector assembly 230 (shown in FIG. 7). The contact sub-assembly 250 includes a base 252, a plurality of contact modules 254 extending from a first surface 256 of the base 252 and a tray 258 extending from a second surface 260 of the base 252. In an exemplary embodiment, the base 252 represents a printed circuit board, and may be referred to hereinafter as printed circuit board 252. The printed circuit board 252 electrically interconnects the first contacts 240 with second contacts 262. The contact modules 254 hold the first contacts 240 and the tray 258 holds the second contacts 262. The first contacts 240 are arranged in a predetermined pattern, such as in quadrants. In an exemplary embodiment, the first contacts 240 are oriented generally diagonally with respect to clearance channels 264 defined between adjacent ones of the contact modules 254. The tray 258 arranges the second contacts 262 in a pattern for mating engagement with the second mating connector 236. In an exemplary embodiment, the tray 258 arranges the second contacts 262 to define an RJ-45 receptacle interface for mating with an RJ-45 plug.

Figure 9:
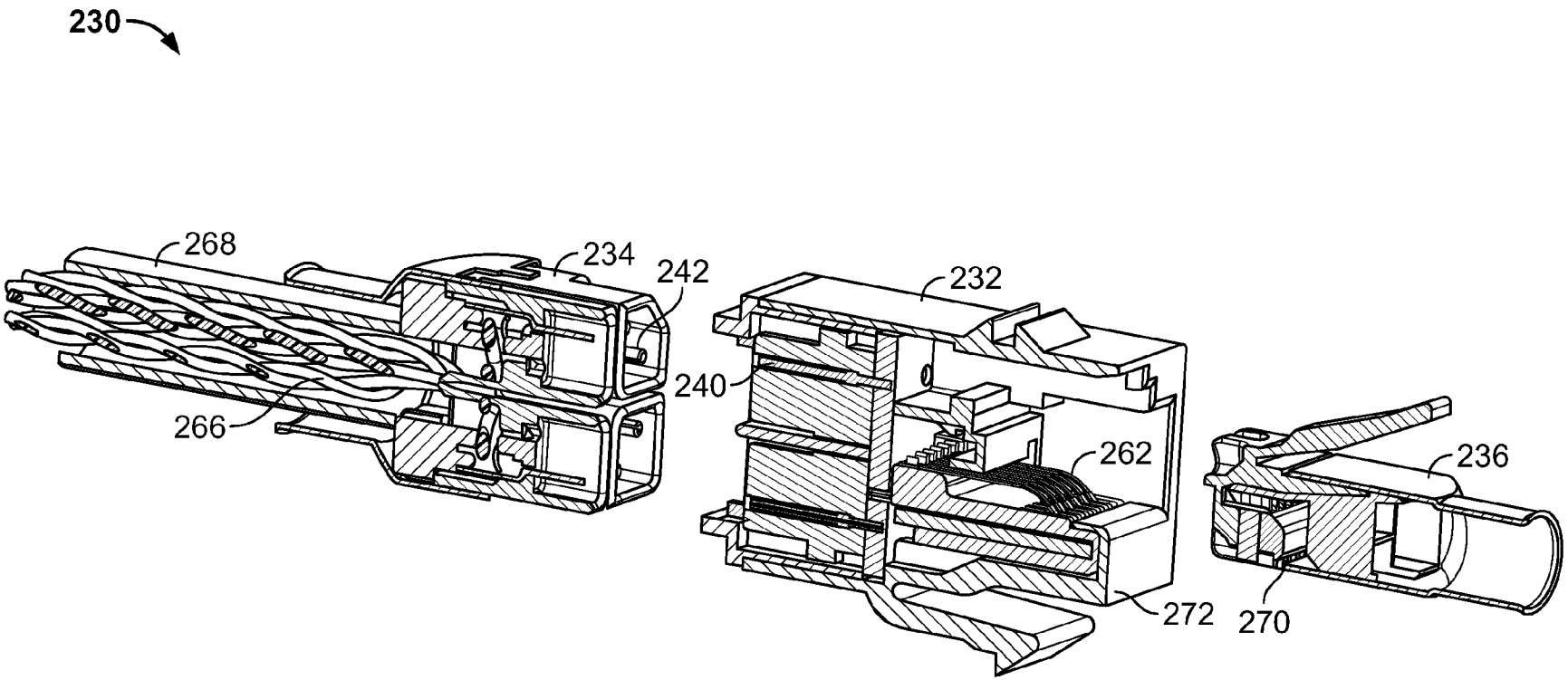
FIG. 9 is a cross-sectional view of the connector assembly shown in FIG. 7.

FIG. 9 is a cross-sectional view of the connector assembly 230. In the illustrated embodiment, the first and second mating connectors 234, 236 are plugged into the coupler 232, which operates to interconnect the first and second mating connectors 234, 236 with one another. In particular, the socket-type contacts 240 receive and interconnect corresponding ones of the pin-type mating contacts 242. In an exemplary embodiment, individual wires 266 of a first cable 268 are terminated to respective mating contacts 242, such as by an insulation displacement connection, insulation piercing connection, crimp connection, soldered connection, indirect printed circuit board connection, or other type of connection. Similarly, wires (not shown) within a second cable (not shown) are terminated to second mating contacts 270 of the second mating connector 236 for mating engagement with the second contacts 262 presented at a second mating end 272 of the coupler 232.

Figure 10:
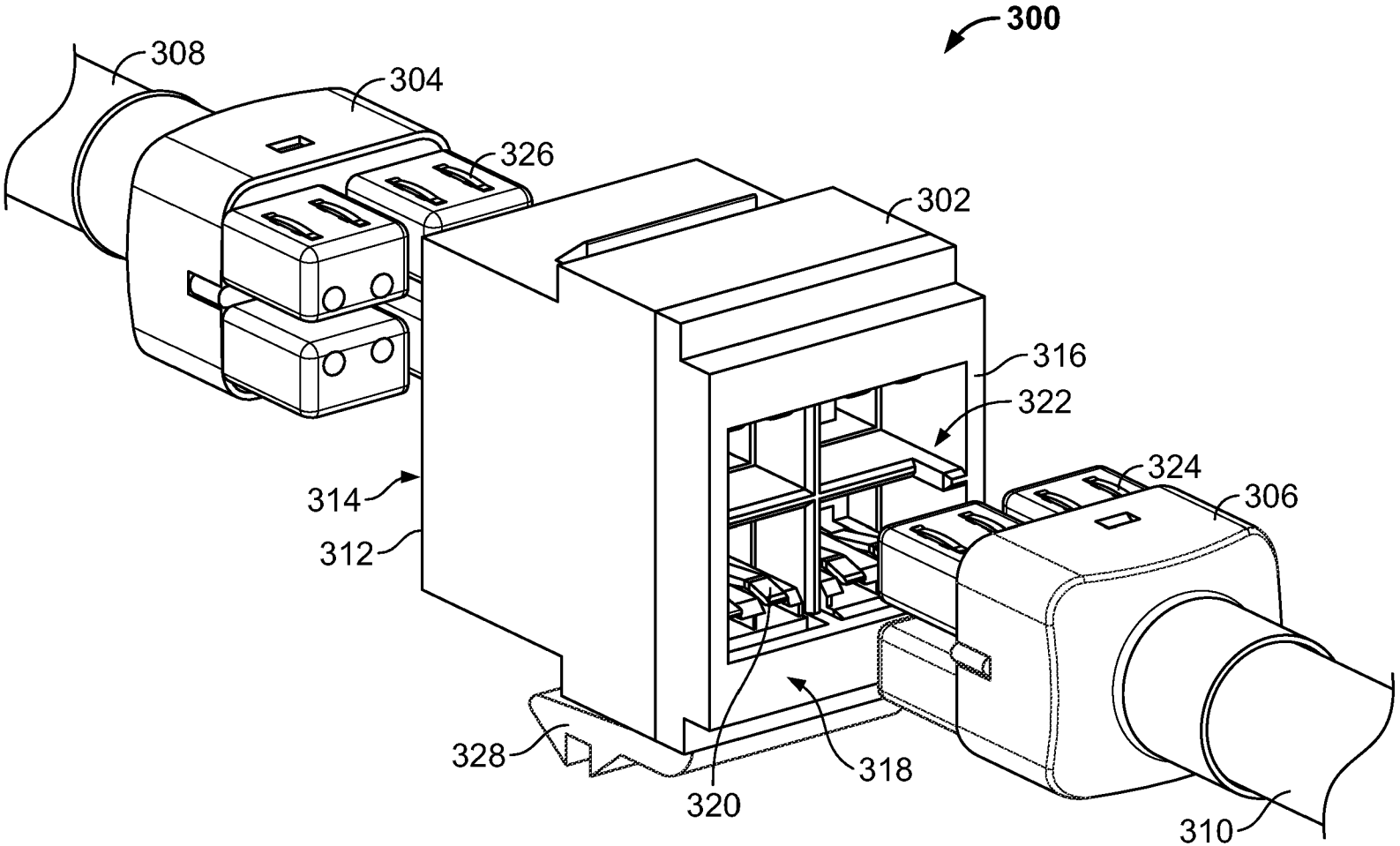
FIG. 10 is a rear perspective view of another alternative connector assembly in an unassembled state illustrating a coupler for interconnecting first and second mating connectors.

FIG. 10 is a rear perspective view of another connector assembly 300 in accordance with an alternative embodiment and in an unassembled state. The connector assembly 300 includes a coupler 302 for interconnecting first and second mating connectors 304, 306. In an exemplary embodiment, the mating connectors 304, 306 are substantially similar to the mating connector 104 illustrated in FIG. 5. For example, the mating connectors 304, 306 define quad plug-type communication connectors each having four pairs of conductors defining different signal paths. The first and second mating connectors 304, 306 are of the same type and are substantially similar in size, structure and mating interface. While the connector assembly 300 is described in terms of an assembly carrying four differential signal pairs, other connectors carrying fewer or greater numbers of signal pairs may be accommodated in alternative embodiments. The mating connectors 304, 306 are provided at the ends of cables 308, 310. The coupler 302 may thus be used to interconnect two cables, such as data cables or communication cables within a network.

The coupler 302 has a first mating end 312 defining a first mating interface 314 and a second mating end 316 defining a second mating interface 318. Optionally, the first and second mating interfaces 314, 318 may be substantially the same for mating with mating connectors that are also substantially the same. The coupler 302 holds a plurality of contacts 320 grouped in differential pairs. The contacts 320 are presented at both the first mating end 312 and the second mating end 316. Optionally, the differential pairs of contacts 320 may be provided in different zones of the mating interfaces 314, 318. In one embodiment, the mating interfaces 314, 318 defines four zones arranged in quadrants, and one differential pair of contacts 320 is arranged in each quadrant. The contacts 320 are arranged in a first pattern at the first mating interface 314 and a second pattern at the second mating interface 318, wherein the first and second patterns are substantially the same.

The coupler 302 includes a second opening 322 at the second mating end 316 that receives the second mating connector 306 therein. The contacts 320 are exposed within the second opening 322 for mating engagement with corresponding mating contacts 324 of the second mating connector 306. The contacts 320 are arranged in a similar pattern as the mating contacts 324 of the second mating connector 304 for interconnection therebetween. Similarly, the coupler 302 includes a second opening (not shown) at the first mating end 312 that receives the first mating connector 304 therein. The contacts 320 are exposed within the first opening for mating engagement with corresponding mating contacts 326 of the first mating connector 304. The contacts 320 are arranged in a similar pattern as the mating contacts 326 of the first mating connector 304 for interconnection therebetween. In an exemplary embodiment, the contacts 320 are arranged in substantially identical patterns at both the first and second mating ends 312, 316.

In an exemplary embodiment, the coupler 302 includes at least one latch 328 for securely mounting the coupler 302 to a structure, such as a wall or panel, or alternatively, in an electrical device or apparatus (not shown) having a communications port through which the device may communicate with other external networked devices.

Figure 11:
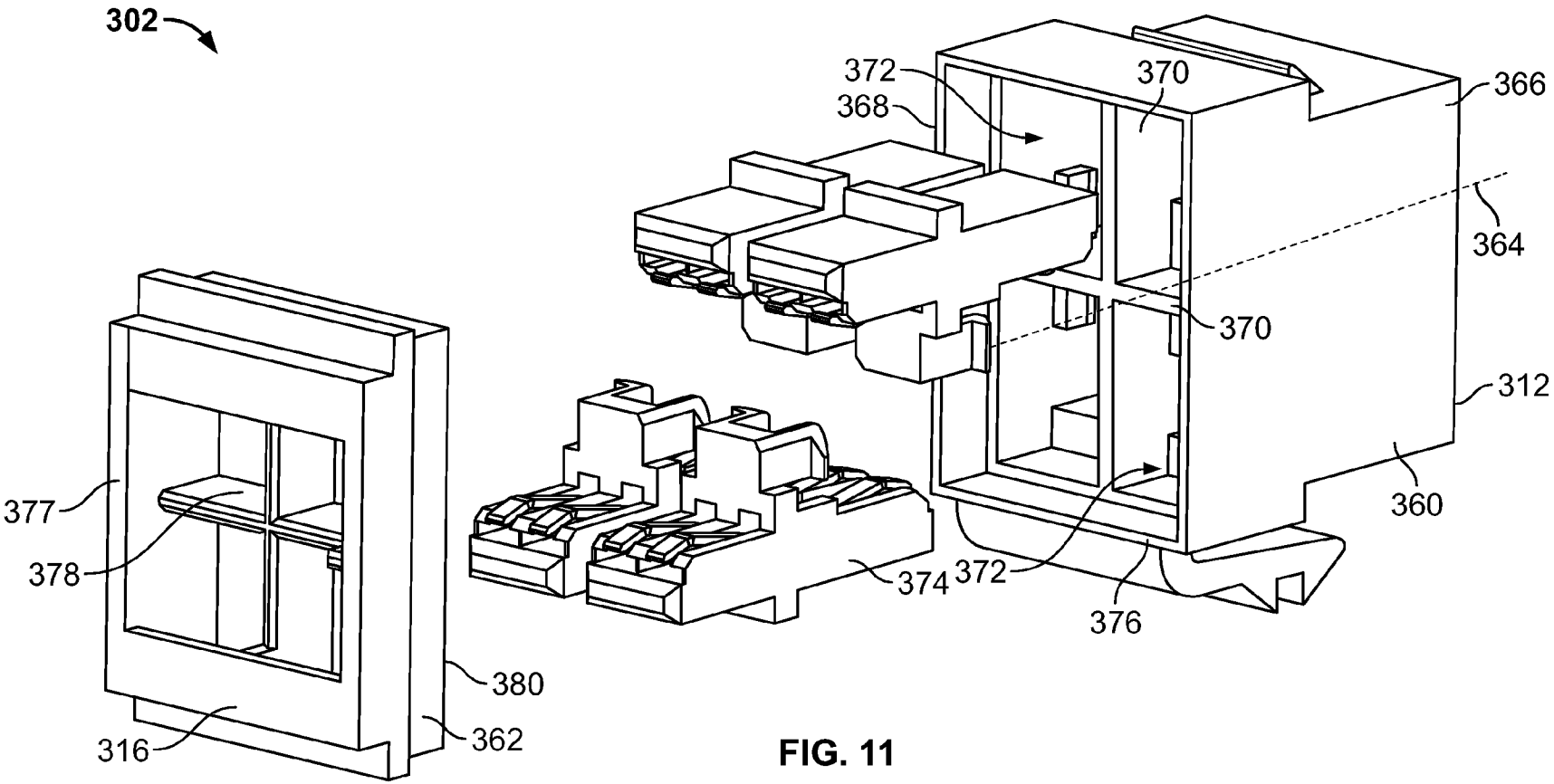
FIG. 11 is an exploded rear perspective view of the coupler shown in FIG. 10.

FIG. 11 is an exploded rear perspective view of the coupler 302. The coupler 302 includes a generally rectangular body 360 and an end cap 362 both of which are fabricated from a conductive material to thereby shield the interior of the coupler 302. In an exemplary embodiment, the body 360 and end cap 362 are fabricated from die cast metal. Other materials, such as metalized plastic may be used in other embodiments. The body 360 extends along a longitudinal axis 364 and includes opposite exterior side walls 366, 368.

A plurality of interior walls 370 divide the interior of the body 360 into a plurality of compartments or wells 372, each of which may hold a contact sub-assembly 374. In an exemplary embodiment, the interior walls 370 provide shielding between the contact sub-assemblies 374. The interior walls 370 thus act as shielding members and may be referred to hereinafter as shielding members 370. Optionally, the contact sub-assemblies 374 may be loaded into the compartments 372 through a loading end 376 of the body 360 and retained within the compartments 372 by retention features, a friction fit, and/or the end cap 362. The compartments 372 are arranged about the longitudinal axis 364 to define different zones or quadrants in the case when four compartments 372 are provided. The shielding members 370 generally extend along the axis 364 between the first mating end 312 and the loading end 376. The shielding member 370 are formed from a conductive material and thereby act as shielding members that shield each contact sub-assembly 374 from adjacent contact sub-assemblies 374. In an exemplary embodiment, the shielding members 370 are integrally formed with the body 360. However, in an alternative embodiment, the shielding members 370 may be separately provided from the body 360. Additionally, in some embodiments the body 360 and/or the shielding members 370 may be fabricated from non-conductive materials.

The end cap 362 includes exterior walls 377 and interior walls 378 that extend along the axis 364 between the second mating end 316 and a loading end 380 that is loaded into the body 360. In an exemplary embodiment, the interior walls 378 provide shielding between the contact sub-assemblies 374. The interior walls 378 thus act as shielding members and may be referred to hereinafter as shielding members 378. The shielding members 378 of the end cap 362 are substantially aligned with the shielding members 370 of the body 360 and define extensions of the compartments 372. The shielding member 378 are formed from a conductive material and thereby act as shielding members that shield each contact sub-assembly 374 from adjacent contact sub-assemblies 374.

Figure 12:
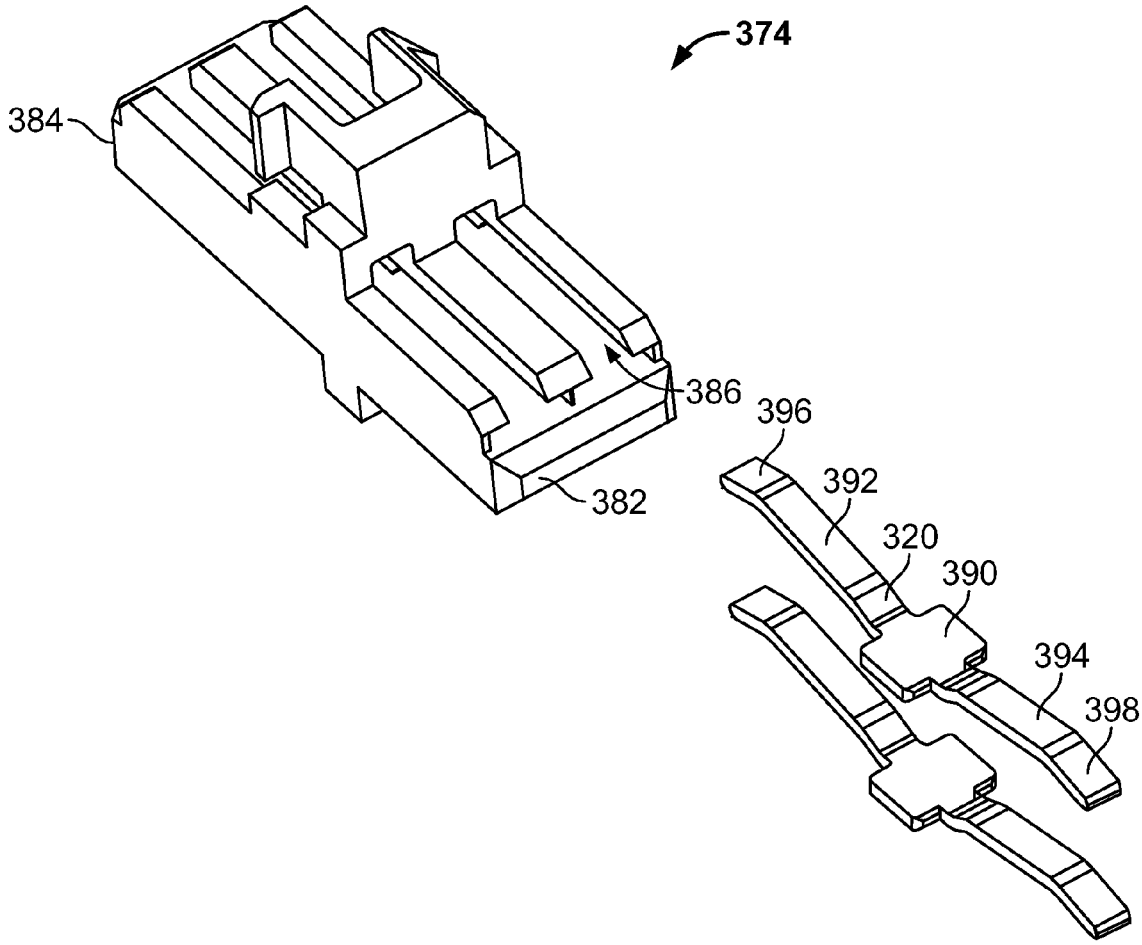
FIG. 12 is an exploded view of a contact sub-assembly for use with the coupler shown in FIG. 11.

FIG. 12 is an exploded view of one of the contact sub-assemblies 374 for use with the coupler 302 (shown in FIG. 10). The contact sub-assembly 374 has a rearward end 382 and a forward end 384. Each contact sub-assembly 374 holds a pair of the contacts 320 that are inserted into contact slots 386 of the contact sub-assembly 374 through the rearward end 382. The contact sub-assembly 374 is fabricated from a specific dielectric material selected to provide desired electrical performance. In an exemplary embodiment, the contact sub-assembly 374 is fabricated from a polycarbonate material.

The contact 320 defines a terminal-type of contact having a generally planar body that is stamped and formed into the contact 320. The contact 320 includes a centrally located retention barb 390, and a pair of flexible beams 392, 394 that extend to mating ends 396, 398. The flexible beams 392, 394 may be bent out of plane with respect to the retention barb 390 to facilitate interconnection with the mating contacts 326 (shown in FIG. 10). Other types of contacts may be provided in alternative embodiments. The retention barb 390 engages the contact sub-assembly material to retain the contact 320 in the contact sub-assembly 374.

Figure 13:
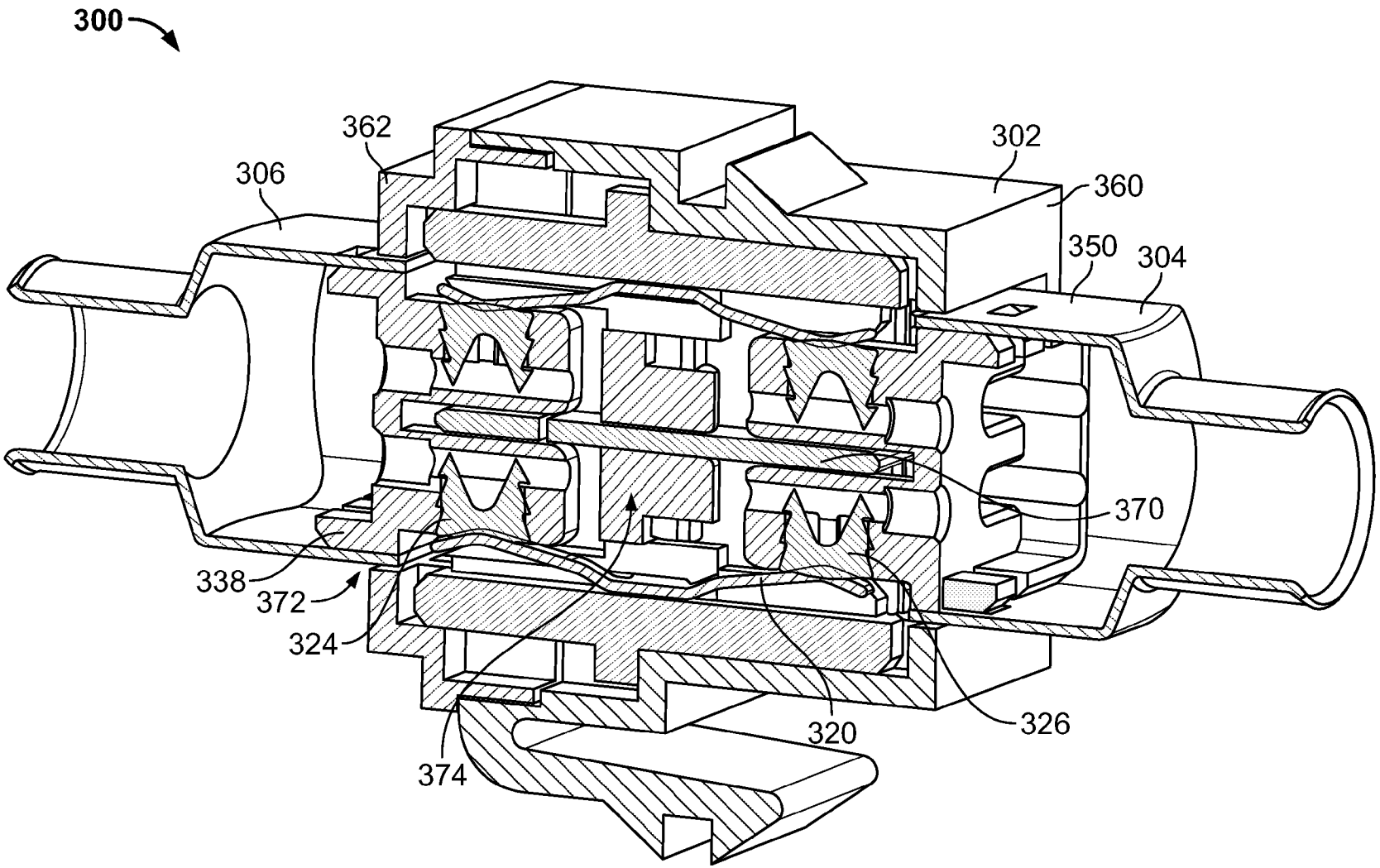
FIG. 13 is a cross-sectional view of the connector assembly in an assembled state.

FIG. 13 is a cross-sectional view of the connector assembly 300 in an assembled state with the cables 308, 310 (shown in FIG. 10) and associated wires removed for clarity. In the illustrated embodiment, the first and second mating connectors 304, 306 are plugged into the coupler 302, which operates to interconnect the first and second mating connectors 304, 306 with one another. In particular, the contacts 320 interconnect corresponding ones of the mating contacts 324, 326. While a single contact 320 is illustrated as interconnecting corresponding mating contacts 324, 326 of the first and second mating connectors 304, 306, it is possible that more than one contact 320 may be used to provide the interconnection, such as by electrically interconnecting the contacts 320, such as through a circuit board or through a direct connection.

In an exemplary embodiment, the shielding member 370 provide internal shielding and/or isolation between the compartments 372 and associated beams 138 and contact sub-assemblies 374. Additionally, the external shields 350 of each of the first and second mating connectors 304, 306 are electrically connected to the body 360 and end cap 362, respectively. As such, external shielding is provided by the external shields 350, body 360 and end cap 362.

Figure 14:
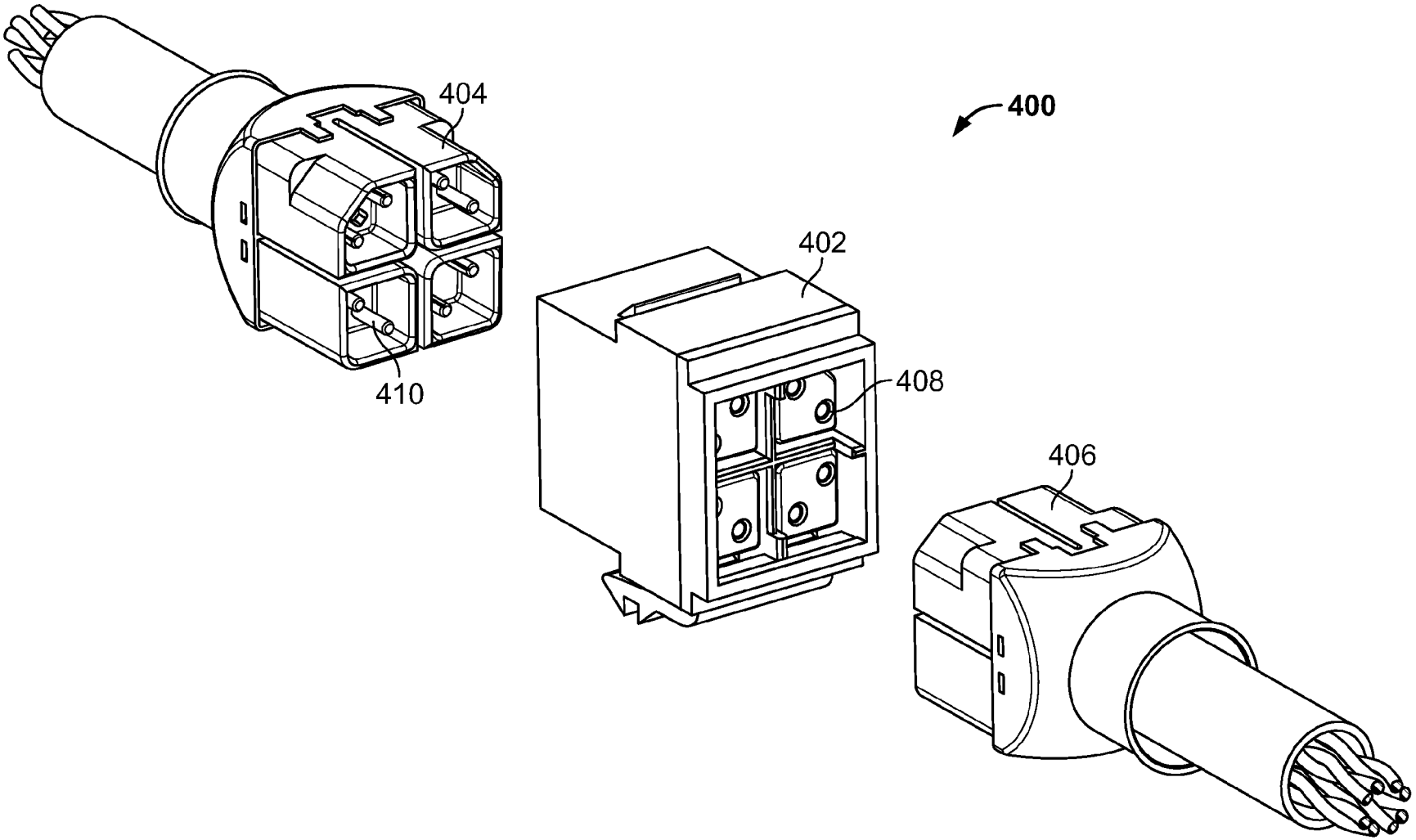
FIG. 14 is a rear perspective view of a further alternative connector assembly in an unassembled state illustrating an alternative coupler for interconnecting alternative mating connectors.

FIG. 14 is a rear perspective view of an alternative connector assembly 400 in an unassembled state illustrating an alternative coupler 402 for interconnecting alternative mating connectors 404, 406. The operation of the connector assembly 400 is similar to the operation of the connector assembly 300, however, the interfaces between the coupler 402 and the mating connectors 404, 406 is different than that of the coupler 302 and mating connectors 304, 306. For example, and as described in further detail below, the coupler 402 includes socket-type of contacts 408 and the mating connectors 404, 406 include pin-type of contacts 410.

Figure 15:
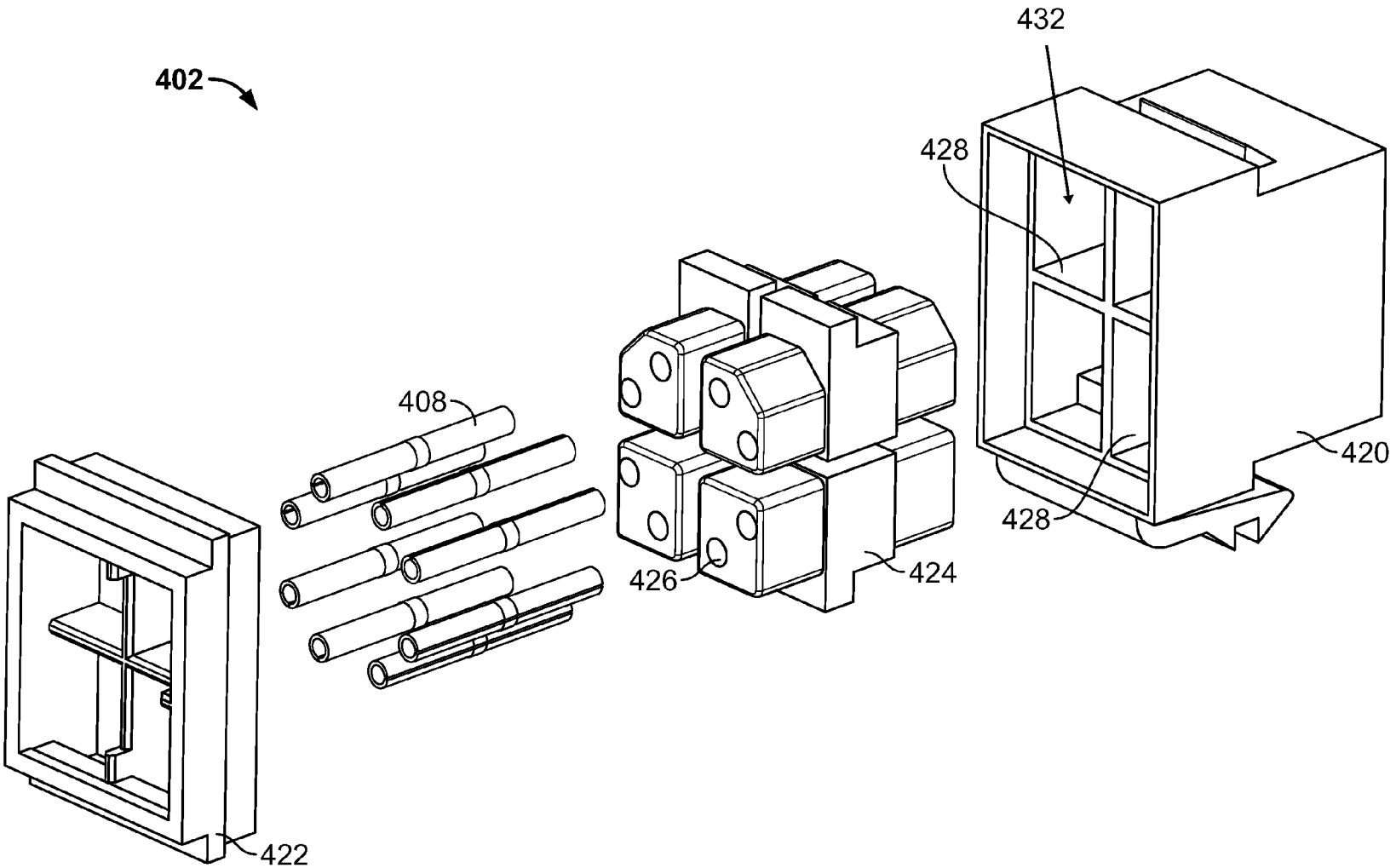
FIG. 15 is an exploded rear perspective view of the coupler shown in FIG. 14.

FIG. 15 is an exploded rear perspective view of the coupler 402. The coupler 402 includes a body 420, an end cap 422 and a plurality of contact sub-assemblies 424. The contact sub-assemblies 424 include contact channels 426 that receive the socket-type contacts 408. The contacts 408 extend between opposed ends of the contact sub-assemblies 424. The contact sub-assemblies 424 are received within respective compartments 432 defined within the coupler 402 by shielding members 428. In an exemplary embodiment, the coupler 402, shielding members 428 and end cap 422 are fabricated from a conductive material to thereby shield between and around the contact sub-assemblies 424 and associated contacts 408.

Figure 16:
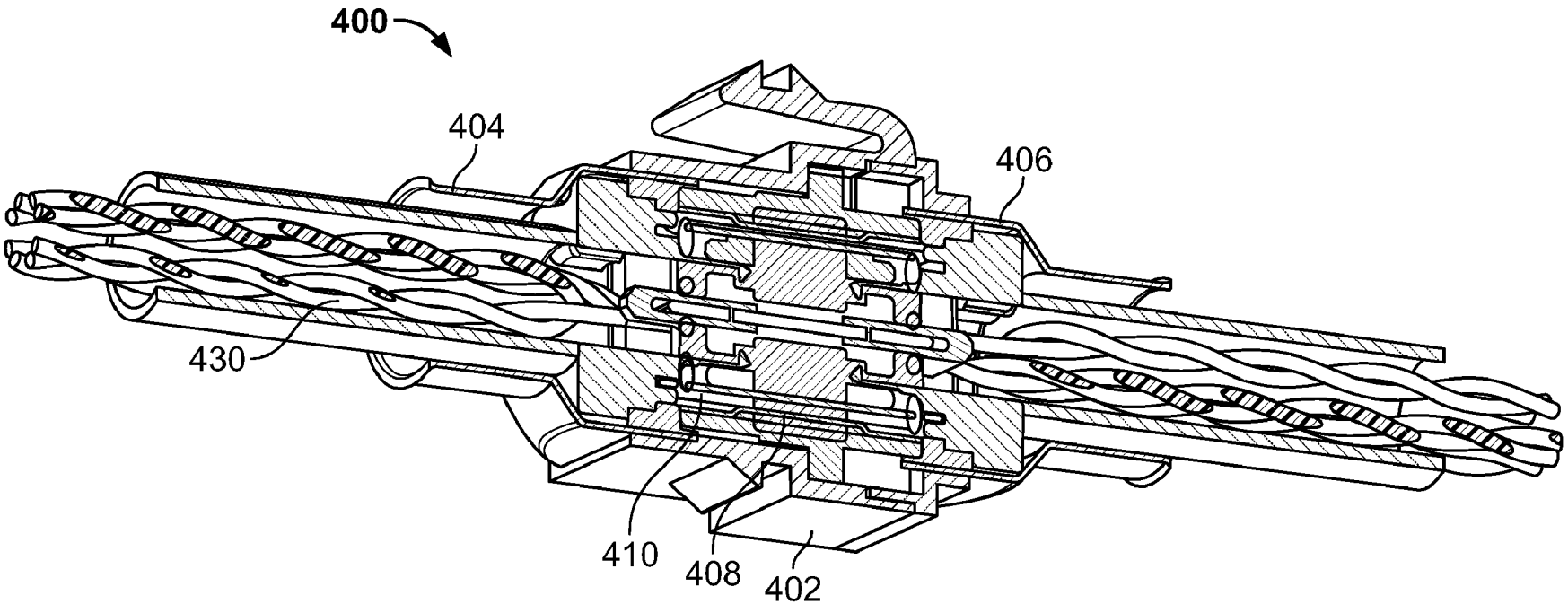
FIG. 16 is a cross-sectional view of the connector assembly shown in FIG. 14.

FIG. 16 is a cross-sectional view of the connector assembly 400 in an assembled state. In the illustrated embodiment, the first and second mating connectors 404, 406 are plugged into the coupler 402, which operates to interconnect the first and second mating connectors 404, 406 with one another. In particular, the socket-type contacts 408 receive and interconnect corresponding ones of the pin-type mating contacts 410. In an exemplary embodiment, individual wires 430 are terminated to respective mating contacts 410, such as by an insulation displacement connection, insulation piercing connection, crimp connection, soldered connection, indirect printed circuit board connection, or other type of connection.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A coupler comprising:

a coupler body having a first mating end defining a first mating interface configured for mating with a first mating connector and a second mating end defining a second mating interface configured for mating with a second mating connector, the coupler body defines an inner chamber;

a contact sub-assembly received within the coupler body, the contact sub-assembly having first contacts grouped in differential pairs and presented at the first mating end and second contacts grouped in differential pairs and presented at the second mating end; and at least one shielding member located within the inner chamber of the coupler body and extending in a first direction and at least one shielding member located within the inner chamber of the coupler body extending in a second direction transverse to the first direction, the shielding members isolating each differential pair of first contacts from an adjacent differential pair of the first contacts.

2. The coupler of claim 1, wherein the at shielding members isolate each differential pair of second contacts from an adjacent differential pair of the second contacts.

3. The coupler of claim 1, wherein the first contacts are integrally formed with corresponding second contacts.

4. The coupler of claim 1, wherein the first contacts are electrically connected to corresponding second contacts via a circuit board arranged within coupler body.

5. The coupler of claim 1, wherein the first contacts are arranged in a first pattern and the second contacts are arranged in a second pattern that is different than the first pattern.

6. The coupler of claim 1, wherein the first contacts are arranged to connect with mating contacts of a quad-plug connector, and the second contacts are arranged to connect with mating contacts of a standard RJ-45 plug connector.

7. The coupler of claim 1, wherein the shielding members define compartments within the coupler body arranged in quadrants, the contact sub-assembly includes contact modules each holding a differential pair of at least one of the first contacts and the second contacts, and each contact module being received in a corresponding one of the compartments.

8. The coupler of claim 1, wherein the contact sub-assembly includes a circuit board arranged within the coupler body, the circuit board having opposed first and second sides extending generally parallel to the first and second mating ends, the first contacts extending from a first side of the circuit board, the second contacts extending from the second side of the circuit board.

9. The coupler of claim 1, wherein the coupler body includes a main body and an end cap coupled to an end of the main body, the main body defining an outer shield surrounding the inner chamber, the end cap having metal interior walls defining the shielding members, the interior walls separating each differential pair from each other differential pair.

10. A coupler comprising:

a coupler body having a first mating end defining a first mating interface and a second mating end defining a second mating interface different than the first mating interface, wherein the first mating interface is configured for mating with a quad-type of mating connector representing a data communication plug, and wherein the second mating interface is configured for mating with a modular plug;

a contact sub-assembly received within the coupler body, the contact sub-assembly having a plurality of contact modules each holding a differential pair of first contacts defining a portion of the first mating interface and the contact sub-assembly having a plurality of second contacts arranged in a row and defining a portion of the second mating interface; and at least one shielding member located within the coupler body, the at least one shielding member isolating each contact module from an adjacent contact module.

11. The coupler of claim 10, wherein the second mating interface is configured for mating with a standard RJ-45 type of mating connector representing a RJ-45 plug.

12. The coupler of claim 10, wherein the contact sub-assembly includes a circuit board and the plurality of second contacts are terminated to the circuit board, the second contacts are presented at the second mating interface, the first contacts are terminated to the circuit board and electrically connected with corresponding second contacts by the circuit board.

13. The coupler of claim 10, wherein the at least one shielding member defines compartments within the coupler body, the contact modules received within corresponding ones of the compartments.

14. The coupler of claim 10, wherein the plurality of second contacts are configured for mating with mating contacts of an RJ-45 plug, wherein each of the first contacts held by the contact modules are electrically coupled to corresponding ones of the second contacts.

15. The coupler of claim 10, wherein the contact sub-assembly includes a circuit board, the contact modules extend from a first surface of the circuit board and a tray extends from a second surface of the circuit board, wherein pairs of the first contacts are held by the contact modules and the second contacts are held by the tray, each of the first contacts are electrically connected to corresponding ones of the second contacts by traces on the circuit board.

16. A coupler comprising:

a coupler body having a first mating end, a second mating end and a plurality of compartments extending along a longitudinal axis and being exposed at each of the first and second mating ends, the coupler body defines a plurality of zones arranged in quadrants with different compartments arranged in different zones;

a plurality of contact sub-assemblies each received within corresponding compartments such that each quadrant receives a different contact sub-assembly, each contact sub-assembly having a pair of contacts, the contacts being presented at both the first mating end and the second mating end for mating engagement with mating contacts of first and second mating connectors received within the coupler body at the first and second mating ends, respectively; and at least one shielding member provided between the contact sub-assemblies for isolating the differential pairs of contacts from one another.

17. The coupler of claim 16, wherein the contacts at the first and second mating ends are unitarily formed.

18. The coupler of claim 16, wherein the differential pairs of contacts are symmetrically arranged about the longitudinal axis.

19. The coupler of claim 16, wherein a first mating interface is defined at the first mating end and a second mating interface is defined at the second mating end, and wherein the first and second mating interfaces are substantially identically formed.

20. The coupler of claim 16, wherein the coupler body is configured to receive the first mating connector, and the contacts are configured to mate with the mating contacts of the first mating connector, at either the first mating end or the second mating end.

* * * * *